US006725940B1

(12) United States Patent
Klein et al.

(10) Patent No.: US 6,725,940 B1
(45) Date of Patent: Apr. 27, 2004

(54) FOAM ADDITIVE SUPPLY SYSTEM FOR RESCUE AND FIRE FIGHTING VEHICLES

(75) Inventors: Andrew P. Klein, Appleton, WI (US); Thomas A. High, Grand Chute, WI (US); Kenneth A. Bolen, Jr., Hortonville, WI (US); Brian D. Piller, Neenah, WI (US); Clarence A. Grady, Larsen, WI (US)

(73) Assignee: Pierce Manufacturing Inc., Appleton, WI (US)

( * ) Notice: Subject to any disclaimer, the term of this patent is extended or adjusted under 35 U.S.C. 154(b) by 0 days.

(21) Appl. No.: 09/567,604

(22) Filed: May 10, 2000

(51) Int. Cl.[7] ..... A62C 35/00

(52) U.S. Cl. ..... 169/15; 169/14; 169/24; 239/69; 239/172; 239/318; 417/46

(58) Field of Search ..... 169/13, 14, 15, 169/24; 239/67, 68, 69, 310, 318, 172; 417/43, 46

(56) References Cited

U.S. PATENT DOCUMENTS

| | | | | |
|---|---|---|---|---|
| 3,677,092 | A | 7/1972 | Guarino | |
| 4,037,664 | A * | 7/1977 | Gibson | 169/15 |
| 4,064,891 | A | 12/1977 | Eberhardt | |
| 4,189,005 | A * | 2/1980 | McLoughlin | 169/13 |
| 4,259,038 | A | 3/1981 | Jorgensen et al. | |
| 4,324,294 | A | 4/1982 | McLoughlin et al. | |
| 4,417,601 | A | 11/1983 | Bennett | |
| 4,436,487 | A | 3/1984 | Purvis et al. | |
| 4,448,256 | A | 5/1984 | Eberhardt et al. | |
| 4,474,680 | A | 10/1984 | Kroll | |
| 4,526,234 | A | 7/1985 | Little | |
| 4,554,939 | A | 11/1985 | Kern et al. | |
| 4,633,895 | A | 1/1987 | Eberhardt | |
| 4,830,589 | A | 5/1989 | Pareja | |
| 4,899,825 | A | 2/1990 | Bosoni et al. | |
| 5,009,244 | A | 4/1991 | Grindley et al. | |
| 5,174,383 | A | 12/1992 | Haugen et al. | |
| 5,218,988 | A | 6/1993 | McNamara et al. | |
| 5,232,052 | A | 8/1993 | Arvidson et al. | |
| 5,284,174 | A | 2/1994 | Norman | |
| 5,291,951 | A * | 3/1994 | Morand | 169/14 |
| 5,313,548 | A | 5/1994 | Arvidson et al. | |
| 5,411,100 | A | 5/1995 | Laskaris et al. | |
| 5,427,181 | A | 6/1995 | Laskaris et al. | |
| 5,494,112 | A | 2/1996 | Arvidson et al. | |
| RE35,362 | E | 10/1996 | Arvidson et al. | |
| 5,680,329 | A | 10/1997 | Lloyd et al. | |
| 5,727,933 | A | 3/1998 | Laskaris et al. | |
| 5,764,463 | A | 6/1998 | Arvidson et al. | |
| 5,765,644 | A | 6/1998 | Arvidson et al. | |
| 5,803,596 | A | 9/1998 | Stephens | |
| 5,816,328 | A | 10/1998 | Mason et al. | |
| 5,909,775 | A | 6/1999 | Grindley | |
| 5,979,564 | A * | 11/1999 | Crabtree | 169/15 |
| 6,009,953 | A * | 1/2000 | Laskaris et al. | 169/13 |
| 6,164,381 | A | 12/2000 | Sundholm | |
| 6,454,540 | B1 * | 9/2002 | Terefinko et al. | 169/13 |

FOREIGN PATENT DOCUMENTS

| | | |
|---|---|---|
| DE | 3038-334 | 10/1982 |

* cited by examiner

*Primary Examiner*—Steven J. Ganey
(74) *Attorney, Agent, or Firm*—Ryan Kromholz & Manion, S.C.

(57) ABSTRACT

A system for supplying a pre-determined ratio of liquid foam concentrate and water to a mixing device immediately upstream from a fire fighting nozzle. The system is electronically balanced by measuring pressure from a plurality of pressure signal sensors and transmitting said pressure signals to a controller unit. A foam additive pump is powered by a fixed displacement piston motor which in turn is electronically modulated independently of the level of operation of the water pump by a control system that is responsive both to the water pressure developed by the water pump and to the foam liquid concentrate pressure developed by the additive pump.

10 Claims, 2 Drawing Sheets

FOAM ADDITIVE SUPPLY SYSTEM FOR RESCUE AND FIRE FIGHTING VEHICLES

BACKGROUND OF THE INVENTION

1. Field of the Invention

This invention relates to systems for extinguishing fires, and in particular to a system for adding liquid foam concentrate into water lines, and mixing the foam concentrate with water in a mixing device, such as a venturi and dispensing said mixture through a nozzle.

2. Description of the Prior Art

Conventional foam additive systems for fighting fires employ numerous mechanisms for supplying foam liquid concentrate via supply conduits to one or more of the discharge outlets of a water pump. The goal of such a system is to achieve "balanced pressure" between the fluid line, typically a water line; and the additive line, typically a foam concentrate supply line. At balanced pressure, the system responds to high fluid pressure with a correlatively high additive pressure, and corresponds to low fluid pressure with a relatively low additive pressure. Thus, at high water pressure and flows, foam is added at an equal pressure and at a flow calculated to maintain a pre-determined ratio of water to foam. The same is true for low pressure and flow.

"Balanced pressure" is particularly important in the fire-fighting field, because the water to foam ratio is critical to optimize fire fighting efficiency based on the type of fire fuel that that is present. Ranges between 0.2%–6% of foam have been reported as optimal, depending on the composition and fuel of the target fire. Further complicating the task of balancing pressure is the extremely variable water flows and pressures. Thus, the amount and pressure of foam must meet the varying pressure and volume of water being used.

Various systems presently exist to attempt "balanced pressure." Early systems used the bladder method to add foam into the water line, such as described in U.S. Pat. No. 5,009,244 (1991) to Grindley et al. In a bladder system, a foam containing bladder is placed inside a pressurized water container, and the water line pressure is equilibrated with the air surrounding the foam bladder, keeping the foam and water at balanced pressure. However, this method severely limited the foam supply, such that realistically only one bladder could be used on each fire. Additionally, when the foam in the bladder was exhausted, bladder change-out was cumbersome and slow.

Another balanced pressure additive system involves an additive pump. These pump systems are of one or two basic types. One embodiment of an additive pump system is a bypass system, in which a foam pump runs at a constant speed discharging foam through a foam discharge outlet. A balanced pressure valve is located at the outlet and the balanced pressure valve allows the unneeded foam to re-circulate into a foam storage tank. However, this system responds poorly to water pressure variation in that it could not maintain exacting water to foam ratios. Another drawback of this system is that the foam tends to become heated as it is re-circulated into the foam storage tank. The heated foam, which has different flow characteristics than ambient temperature foam, mixes poorly with ambient temperature water. In addition the foam in the storage tank can become aerated due to the large quantity of foam being re-circulated. This aerated foam can cause the system to act erratic when it is drawn into the suction side of the foam pump.

Another embodiment of an additive pump system is a hydraulically powered demand system that varies additive pump output in response to different readings from a flow meter installed in the water pump discharge line that measures water flow rate. This system is disclosed in U.S. Pat. No. 5,174,383 (1992) to Haugen et al. The flow meter signal is processed by a microprocessor to match the output of the flow on the additive pump with a measure of the additive pump output fed back to the microprocessor to maintain the additive flow rate at the proper proportion to the water flow rate.

U.S. Pat. No. 4,436,487 (1984) to Purvis et al. teaches an improved system for supplying foam liquid concentrate to water pump discharge outlets wherein the output of the concentrate pump is controlled in accordance with the demand for liquid concentrate, irrespective of variations in water pump flow rate and operating pressure. This is achieved by driving the foam concentrate pump with a variable output hydraulic drive, which in turn is automatically modulated independently of the level of operation by the water pump by a hydraulic control circuit responsive both to the water pressure developed by the pump and to the foam liquid concentrate pressure developed by the concentrate pump. The hydraulic control circuit includes a fluid pressure responsive adjusting mechanism for varying the displacement of the hydrostatic pump. A servo control module is connected in the hydraulic control circuit between a rotary gear charge pump and the adjusting mechanism. The servo control module operates to modulate the hydraulic fluid pressure being applied to the adjusting mechanism in response to variations in the water pressure developed by the water pump and the foam liquid concentrate pressure developed by the concentrate pump. In other words, this system uses hydraulics to control the balanced pressure system. The servo control module senses the foam concentrate pressure and the water pressure. This in turn sends hydraulic fluid through a valve system that actuates a cylinder in the pump. The cylinder then mechanically changes the stroke of the hydraulic pump.

Another system is disclosed in U.S. Pat. No. 5,816,328 (1998) to Mason et al. To again maintain balanced pressure, a balances pressure valve with electric switches provides the required control. The system has two limit switches that are actuated when the shaft of the balanced pressure valve rises or falls. These switches start or stop an electric motor that with a cable that controls the stroke of the hydraulic pump. Because of the imprecise control, the balance valve is also capable of sending excess foam concentrate to the suction side of the foam pump for proper proportioning.

These prior art systems are either entirely mechanical in nature or electric components (i.e. switches and motors) are used to control the hydraulic pump. The present invention utilizes an electronic programmable logic controller to control the hydraulic pump.

The programmable controller provides the following advantages. The system has increased reliability due to the durability of circuit boards with no moving components. The system response time is increased due to advantages of electronics compared to mechanical methods. This response time is critical in this application due to the changes in flows and pressures at the fire scene. The accuracy of the system is critical with firefighter safety when using a class B foam blanket.

SUMMARY OF THE INVENTION

A basic objective of the present invention is to avoid the above-mentioned problems by monitoring fluid pressures not fluid flow, and electrically or electronically controlling foam additive flow. This solves a long-felt need for an accurate foam proportioning system based on demand. These and other objectives and advantages of the present invention are achieved in a preferred embodiment to be hereinafter described in greater detail. By contrast, the above-noted prior art devices rely upon fluid flow or hydraulic balancing circuits for maintaining balanced pressure. The prior art systems do not electronically control foam additive flow.

The foam additive system comprises a source of pressurized water, a water supply system in fluid communication with the source of pressurized water, and a fluid/additive mixing device in fluid communication with the water supply system. An additive pump, a motor, such as a piston motor mechanically coupled to the additive pump, and an additive supply line system connect the additive source with the fluid/additive mixing device. The additive supply line system is in fluid communication with the additive pump. An additive pump control apparatus is present for varying the rate of foam additive. The additive pump control apparatus is connected to the motor and the additive pump. The control apparatus is responsive to and in communication with a measure of additive supply line system pressure and a measure of water supply system pressure. Pressure transducers are utilized to measure the foam additive system pressure and the water supply system pressure.

The additive supply system further comprises a variable output hydraulic drive means coupled to and powering the motor. A hydraulic fluid reservoir supplies the hydraulic fluid required for the system. A hydrostatic pump having a pressure compensator and a swash plate is also provided, the hydrostatic pump being in fluid communication between the reservoir and the motor. In addition there is provided a second motor for driving the hydrostatic pump, the hydrostatic pump being operable to supply hydraulic fluid under pressure to the motor, and the hydrostatic pump having a variable displacement controlled by a pressure compensator.

The novelty or improvement of the present system includes an electronic proportional relief valve fluidly coupled to the hydrostatic pump and the hydraulic fluid reservoir and electronically connected to a digital controller. The aforementioned pressure transducers send electronic signals to the digital controller. The electronic proportional relief valve receives an electronic signal from the digital controller that in turn communicates a hydraulic pressure signal to the pressure compensator. In response to changes in the hydraulic pressure signal received from the proportional relief valve, the pressure compensator adjusts the swash plate. The compensator features the sensing ability to respond to pressure changes as quick as three variations per second. The compensator and an in-line orifice also serve as a speed control based on load sensing, preventing the additive pump's hydraulic motor from exceeding a predetermined speed.

By using two electronic signals from the pressure transmitters, a method of electronically varying the additive supply system is also disclosed.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

Figure 1:
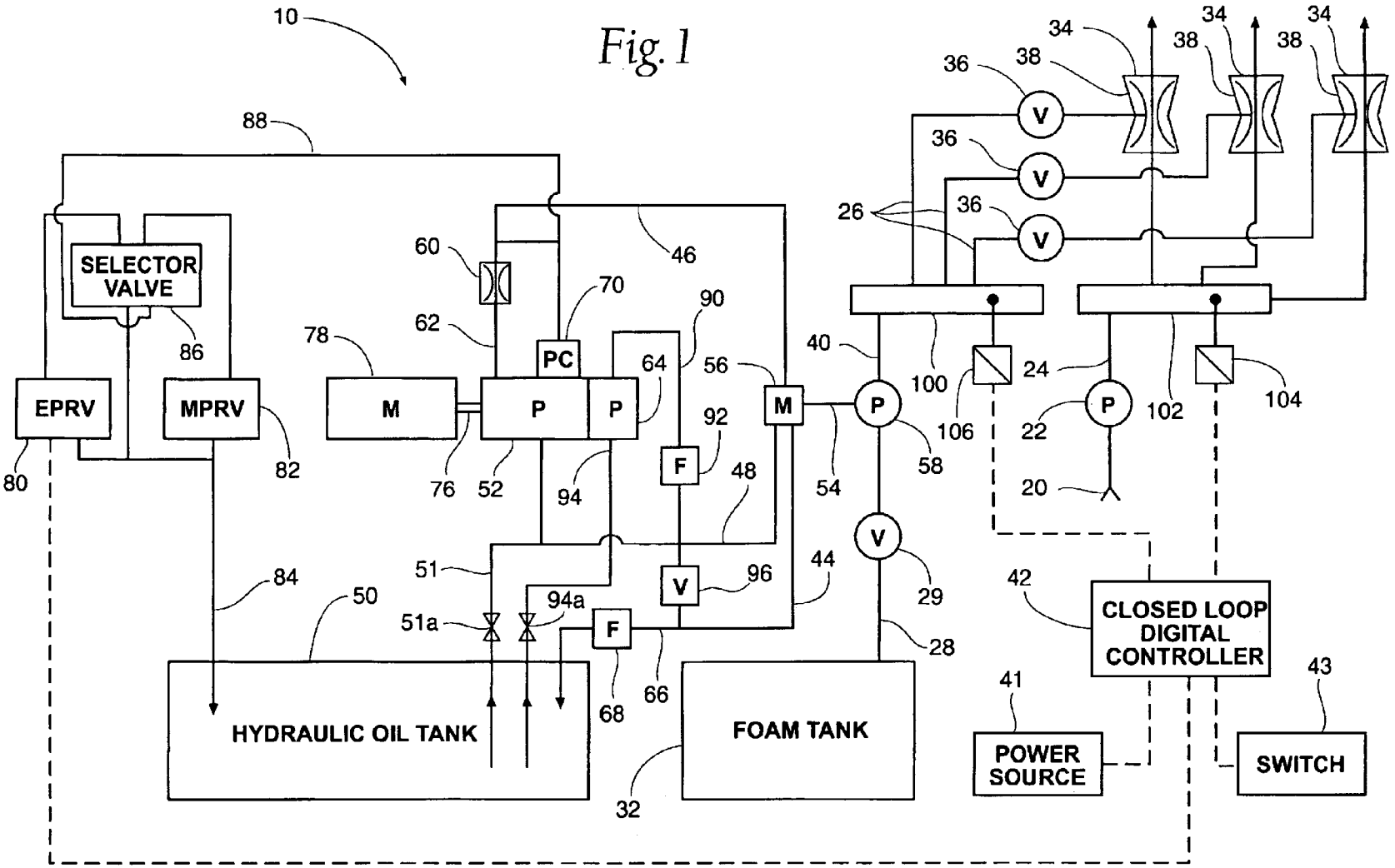
FIG. 1 is a schematic representation of a preferred embodiment of a system in accordance with the present invention.

A preferred embodiment of a system 10 embodying the concepts of the present invention is shown schematically in FIG. 1. Pressurized water is supplied via the water supply 20. The water supply 20 is connected to a water pump 22 as is common in fire fighting apparatus. Conduit 24 connects pump 22 with a water manifold 102. Alternatively, a different source of pressurized water source could be provided.

Liquid foam concentrate is supplied from tank 32. Foam tank 32 is connected to a foam pump 58 as is again common in fire fighting apparatus. Conduit 28 connects foam tank 32 with pump 58 and conduit 40 connects pump 58 with foam concentrate manifold 100. A valve 29 is provided in conduit 28 to control the introduction or non-introduction of foam in the system. Separate means (not shown) are provided to refill the foam tank 32 or allow for the connection of an external foam concentrate source. As will be apparent to those skilled in the art, a different or alternate source of liquid foam concentrate could be provided.

The additive supply system 10 is further provided with one or more fluid/additive mixing devices 34 through which water may be pumped after being drawn from its source 20. In the preferred embodiment, a thixotropic material is the additive traditionally mixed with water and used to fight fires. More preferably, liquid foam concentrate is the additive to the water. However, additives other than a thixotropic material or liquid foam concentrate may be used based on fire fighting efficacy.

Each fluid/additive mixing device 34 has a metering valve 36 and a fluid pressure drop inducing device 38 associated therewith. Each valve 36 operates to open and close the liquid foam additive conduit 26 just prior to the fluid/additive mixing devices 34 and to vary the amount or percentage of foam concentrate to be mixed with the water. In most applications, foam concentrate is proportioned with water at 0.3% to 6% depending upon the type of fire operation required. The pressure drop inducing device 38 operates to admit the liquid foam additive concentrate into the fluid/additive mixing devices 34 via the foam supply lines 26. The pressure drop inducing devices 38 can be of a modified venturi type, or of any other type known to those skilled in the art. Such devices create a lowered pressure zone in the discharge outlets thereby causing foam liquid concentrate to be admitted at flow rates that are directly proportional to the flow rate of the water being pumped there-through when the valve 36 is open. Both the valves 36 and pressure drop inducing devices 38 are well known in the art. Downstream from each pressure drop inducing device 38, there may be provided (not shown) a discharge valve for controlling the flow of water or water mixed with foam concentrate to a subsequent nozzle or similar device.

The additive system 10 further comprises a liquid foam concentrate additive pump 58 and an hydraulic motor 56, which can be a fixed displacement axial piston motor. The motor 56 may be of known design, such as for example a widely available "Mannesmann Rexroth AA2FM (A2FM)," supplied by the Mannesmann Rexroth Corporation of Wooster, Ohio. The output speed is proportional to input flow and inversely proportional to displacement. Drive torque increases with the pressure drop across the motor. The foam additive pump 58 is preferably a positive displacement foam pump of the rotary gear type manufactured by Edwards Corporation of Milwaukie, Oreg. The fixed displacement hydraulic motor 56 is mechanically coupled to the additive pump 58 with a shaft 54.

Still referring to FIG. 1, the fixed displacement motor 56 receives hydraulic fluid from hydraulic fluid conduit 46. This supply source will be discussed in detail below. The hydraulic fluid from motor 56 is returned to the hydraulic fluid source 50 through conduit 48 that passes through charging pressure relief valve 96 and filter 68 before reaching tank 50. A separate return line 44 is provided for returning hydraulic fluid that accumulates in the case of motor 56 to hydraulic oil tank 50. This fluid also passes through filter 68.

An additive pump control apparatus 42, such as a programmable controller or closed loop digital controller, is provided for varying the rate of the piston motor 56 which in turn varies the rate of the additive pump 58. In the preferred embodiment, the additive pump control apparatus programmable digital controller 42 is a EH129A1A Control Card manufactured by DITCO, Inc of Kent, Wash. A power source 41, such as the power source from the rescue or fire fighting vehicle, provides power to the controller 42. A switch or switching means 43 is also provided to turn the controller 42 "on" and "off" at the appropriate times. The additive pump control apparatus 42 receives input data from the water manifold 102 and foam manifold 100 and sends an output signal to an electronic proportional relief valve, as will be explained in greater detail. The additive pump control apparatus 42 is responsive to and in communication with a measure of additive supply line system pressure and a measure of water supply line system pressure.

In the preferred embodiment, both the additive supply line system and the water supply system include manifolds 100 and 102 respectively, from which pressure transducers 104 and 106 receive a measure of the pressure of the additive or the water in the manifold. The controller 42 is programmed to calculate the hydraulic volume and pressure of the foam additive required to balance the system 10, based on the measures transmitted from the pressure transducers 104 and 106. There are many suitable transducers that are well known to those skilled in the art.

The additive supply system 10 further includes a variable output hydrostatic pump 52 coupled to an internal rotary gear charge pump 64. The hydrostatic pump 52 and rotary gear charge pump 64 are in fluid communication between the hydraulic fluid reservoir 50 and the piston motor 56. They operate to supply hydraulic fluid under pressure to the motor 56. The hydrostatic pump 52 draws hydraulic fluid from tank 50 through line 51 as shown in FIG. 1. A shut-off valve 51a is provided in line 51.

Figure 2:
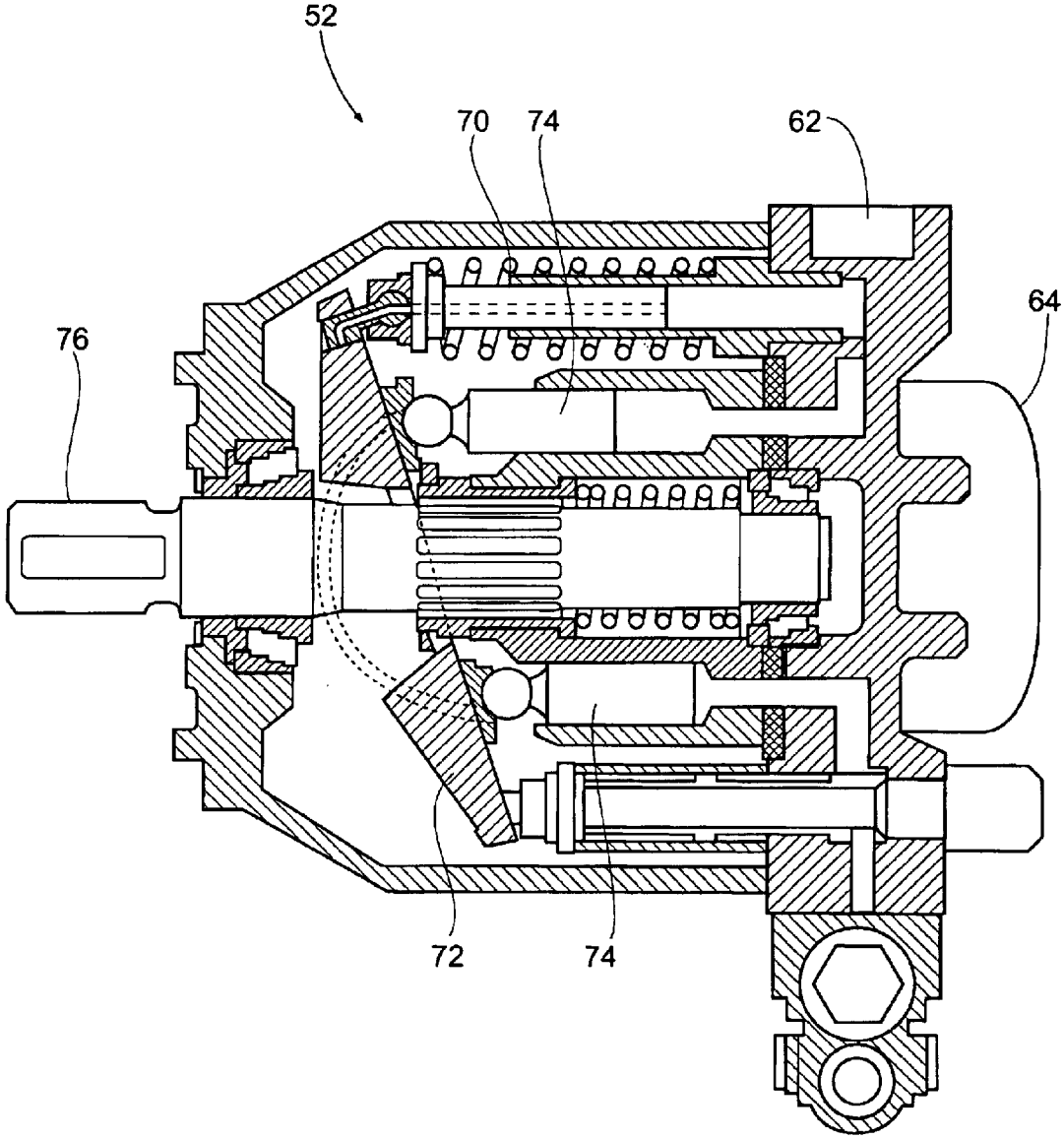
FIG. 2 is a cut-away view of a combined variable displacement hydrostatic pump and rotary gear charge pump of the type shown in FIG. 1.

Now referring to FIG. 2, the hydrostatic pump 52 includes a pressure compensator 70 including a swash plate 72. The pump 52 is a variable displacement, axial piston pump of swash plate design. Flow from the pump 52 is proportional to the drive speed and the displacement. By adjusting the position of the swash plate 72 a stepless variation of the flow is possible. The hydrostatic pump 52 variable displacement output is through conduit 62. In addition the output may be enhanced by the pressure compensator 70. An orifice 60 is provided in conduit 62 to accomplish load sensing. The hydrostatic pump 52 is preferably of known design, for example the "Series AA10VSO" variable displacement axial piston pump also supplied by Mannesmann Rexroth Corporation.

With reference to FIG. 2, it will be seen that pump 52 includes a rotatable rocker cam swash plate 72 arranged to contact with a plurality of inline pistons 74 in developing a displacement or output which varies depending on the inclination of the plate 72 in relation to its rotational axis and the speed at which the pump 52 is being driven. The design and operation of such pumps is well known to those skilled in the art, and hence no further explanation is required. An internal rotary gear charge pump 64 is coupled to the hydrostatic pump 52, and both pumps are driven through a common input shaft 76. Shaft 76 is connected to a drive motor 78. In most applications, the drive motor 78 is the engine or main power source of the fire fighting apparatus.

An electronic proportional pressure relief valve 80 is fluidly coupled to the pressure compensator 70 of the variable displacement pump 52 through selector valve 86. By way of example only, the preferred pressure relief valve is a Model No. DBET, Series 5X proportional pressure relief valve manufactured by Mannesmann Rexroth Corporation. Fluid line 88 supplies hydraulic fluid to the selector valve 86. From the selector valve 86, fluid is supplied to either the electronic proportional relief valve 80 or a manual proportional relief valve 82. The manual proportional relief valve is provided so that the operator of the rescue or fire fighting vehicle may manually control the system 10 if desired. The electronic proportional relief valve output and the manual proportional pressure relief valve outlet are fluidly coupled to the hydraulic reservoir or hydraulic oil tank 50 by way of conduit 84.

The electronic proportional relief valve 80 receives an electronic signal from the programmable controller 42 and controls the output or return of pressure compensator 70 by way of conduit 88. In response to changes in the pressure signal received from the proportional relief valve 80, the pressure compensator 70 adjusts the inclination of swash plate 72. The compensator 70 features the sensing ability to respond to pressure changes as quick as one quarter (¼) of a second.

The compensator 70, in parallel fluid communication with the pump's output pressure across orifice 60 from the pump's discharge conduit 62, also serves as a speed control based on load sensing, preventing the piston motor 56 from exceeding a predetermined safe speed (i.e prevents an overspeeding condition). In addition, this protects both the pump 52 as well as the transmission of fluid pressure spikes through the system 10.

The rotary gear charge pump 64 is connected via a hydraulic fluid suction line 94 to the hydraulic fluid reservoir tank 50. As shown in FIG. 1, a shut-off valve 94*a* is provided in line 94. The combined assembly of the hydrostatic pump 52 and rotary gear charge pump 64 may be driven by any convenient means, but preferably the pump assembly is driven by a drive motor 68 via a power take off connection 76. In a preferred embodiment, the pump assembly is driven by the water pump transmission or gearbox. The output of the rotary gear charge pump 64 is conducted via a discharge line 90 which passes through a filter 92 and a charging pressure relief valve 96 before returning to the hydraulic oil tank 50.

The operation of the system 10 will now be explained. If foam generation is not required valves 36 adjacent additive mixing devices 34 will be in the off position. At this time, selector valve 86 is adjusted to its off position and hydraulic fluid will be bled from the piston motor 56 through conduit 48, relief valve 96, filter 68, and back into the reservoir 50. This will allow the swash plate 72 to assume a neutral operating condition in which no fluid is being pumped through conduit 88 and ultimately to the proportional relief valve 80. Because the fluid is being bled from piston motor 56, the additive pump 58 will remain inoperative.

When at least one of the valves 36 is opened and as a result of the application of a resultant electronic signal to the proportional relief valve 80, the inclination of the swash plate 72 will be changed and the output of the hydrostatic pump 52 will be automatically elevated and controlled, thereby delivering fluid through conduit 46 to the piston motor 56. This will correspondingly immediately start and elevate the output of the foam additive pump 58. It should be noted, however, that orifice 60 will prevent an over-speeding condition of piston motor 56. Thus it will be appreciated that the output of the foam additive pump 58 will be automatically modulated as a function of both water pressure and concentrate pressure.

If only a few of the water supply discharge outlets are being fed with liquid foam concentrate via their respective pressure drop inducing devices 38, then the output of the additive pump 58 will be controlled at a relatively low level which is sufficient to meet the existing demand for foam concentrate. Nevertheless, the desired balance between water pressure and concentrate pressure will be maintained, without requiring any of the concentrate to be re-circulated from the discharge side of the additive pump 40 back to the foam tank 32. This result will be achieved irrespective of the flow rate and operating pressure of the water supply 20.

If all of the remaining water supply discharge outlets and foam concentrate valves 36 are instantly opened, then both the foam manifold pressure sensor 106 and water manifold pressure sensor 104 will transmit a low pressure signal to the controller 42. The electronic pressure relief valve 80 will immediately close thereby sending a greater volume of hydraulic fluid through conduit 46 and ultimately to piston motor 56.

When some of the foam concentrate valves 36 are closed, foam manifold pressure transducer 106 will experience an increase in pressure. A corresponding electronic signal will be sent to the pressure relief valve 80. Relief valve 80 will allow a greater volume of hydraulic oil to be returned to tank 50 through conduit 84 thereby reducing the flow of hydraulic fluid to piston motor 56. Piston motor 56 and foam pump 58 will each slow down as less foam concentrate is now required at the still open pressure drop inducing devices 38.

Experience with the system of the present invention 10 has shown that it is possible to maintain a balance between water pressure and foam liquid concentrate pressure within one-half (½) p.s.i. This in turn makes it possible to operate at lower pressure drops through mixing devices 34 as compared with conventional systems, and still maintain accurate proportioning ratios.

By electronically controlling the additive pump 58 in response to the measure of additive supply line system pressure and the measure of water supply system pressure, a method of proportioning additive to a fluid/additive mixing device 34 in balanced pressure with a water line is achieved. By transmitting the water supply system pressure to the programmable controller 42, calculating hydraulic volume and pressure of water required to balance the system, transmitting the foam additive supply line system pressure to the programmable logic controller 42, calculating hydraulic volume and pressure of foam additive required to balance the system, it is possible to accurately adjust the speed of the additive pump 58 to maintain balanced pressure.

In light of the foregoing, it will now be apparent to those skilled in the art that changes and modifications may be made to the embodiment herein described. For example, the hydrostatic pump 52 and rotary gear charge pump 64 may be separated and possibly driven by different power sources.

The foregoing is considered as illustrative only of the principles of the invention. Furthermore, since numerous modifications and changes will readily occur to those skilled in the art, it is not desired to limit the invention to the exact construction and operation shown and described. While the preferred embodiment has been described, the details may be changed without departing from the invention, which is defined by the claims.

What is claimed is:

1. An additive supply system for fire fighting mechanisms, the additive system comprising:

a means for supplying pressurized water to a mixing device;

a means for supplying pressurized additive to the mixing device for mixing with the pressurized water;

a pressure transducer for measuring the pressure of the pressurized water prior to mixing with the pressurized additive, said pressure transducer being fluidly coupled to the means for supplying pressurized water;

a means for measuring the pressure of the pressurized additive prior to mixing with the pressurized water, said means for measuring the pressure of the pressurized additive fluidly coupled to the means for supplying pressurized additive; and a means for controlling an output of the means for supplying pressurized additive to the mixing device in response to both the pressure of the pressurized water and the pressure of the pressurized additive, said means for controlling the output electronically coupled to said pressure transducer and said means for measuring the pressure of the pressurized additive.

2. An additive supply system according to claim 1, wherein the means for controlling the output of the means for supplying pressurized additive to the mixing device in response to both the pressure of the pressurized water and the pressure of the pressurized additive is digital electronic.

3. An additive supply system according to claim 1, the additive supply system further comprising, a means for adjusting the speed of an additive pump by varying the displacement of a hydraulic pump fluidly coupled to the additive pump by adjusting a swash plate in the hydraulic pump, the means for adjusting the speed of an additive pump controlling the output of the means for supplying pressurized additive to the fluid/additive mixing device in response to both the pressure of the pressurized water and the pressure of the pressurized additive.

4. An additive supply system according to claim 3, wherein the means for adjusting the speed of an additive pump is a swash plate in the hydraulic pump adjusted by a pressure compensator in the hydraulic pump that responds to a hydraulic pressure signal sent from a proportional relief valve.

5. A vehicle carrying an additive supply system according to claim 1.

6. An additive supply system for fire fighting mechanisms, the additive system comprising:

a means for-supplying pressurized water to a mixing device;

a means for supplying pressurized additive to the mixing device for mixing with the pressurized water;

a means for measuring the pressure of the pressurized water prior to mixing with the pressurized additive, said means for measuring the pressure of the pressurized water fluidly coupled to the means for supplying pressurized water;

a pressure transducer for measuring the pressure of the pressurized additive prior to mixing with the pressurized water, said pressure transducer being fluidly coupled to the means for supplying pressurized additive; and a means for controlling an output of the means for supplying pressurized additive to the mixing device in response to both the pressure of the pressurized water and the pressure of the pressurized additive, said means for controlling the output electronically coupled to said means for measuring the pressure of the pressurized water and said pressure transducer.

7. An additive supply system according to claim 6, wherein the means for controlling the output of the means for supplying pressurized additive to the mixing device in response to both the pressure of the pressurized water and the pressure of the pressurized additive is digital electronic.

8. An additive supply system according to claim 6, the additive supply system further comprising, a means for adjusting the speed of an additive pump by varying the displacement of a hydraulic pump fluidly coupled to the additive pump by adjusting a swash plate in the hydraulic pump, the means for adjusting the speed of an additive pump controlling the output of the means for supplying pressurized additive to the fluid/additive mixing device in response to both the pressure of the pressurized water and the pressure of the pressurized additive.

9. An additive supply system according to claim 8, wherein the means for adjusting the speed of an additive pump is a swash plate in the hydraulic pump adjusted by a pressure compensator in the hydraulic pump that responds to a hydraulic pressure signal sent from a proportional relief valve.

10. A vehicle carrying an additive supply system according to claim 6.

* * * * *